US006661994B2

(12) United States Patent
Ohuchi et al.

(10) Patent No.: US 6,661,994 B2
(45) Date of Patent: Dec. 9, 2003

(54) ELECTROPHOTOGRAPHIC IMAGE FORMING SYSTEM

(75) Inventors: Yoshio Ohuchi, Tokai-mura (JP); Kazuhiro Wakamatsu, Hitachi (JP); Hisao Suka, Hitachi (JP); Katsumi Kumada, Kitaibaraki (JP); Chikara Hiraoka, Hitachi (JP); Shizuo Tsuruta, Hitachi (JP); Yoshitaro Ishii, Hitachi (JP); Akira Sasaki, Hitachi (JP); Masahiko Saito, Kitaibaraki (JP); Seiji Okunomiya, Hitachinaka (JP); Tetsunori Kaneko, Hitachi (JP); Masashi Yamamoto, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/207,038

(22) Filed: Jul. 30, 2002

(65) Prior Publication Data

US 2002/0176726 A1 Nov. 28, 2002

Related U.S. Application Data

(63) Continuation of application No. 09/801,847, filed on Mar. 9, 2001.

(30) Foreign Application Priority Data

Aug. 31, 2000 (JP) ..... 2000-268377
Aug. 31, 2000 (JP) ..... 2000-268378
Aug. 31, 2000 (JP) ..... 2000-268379

(51) Int. Cl.[7] ..... G03G 15/10
(52) U.S. Cl. ..... 399/400; 399/322; 399/323
(58) Field of Search ..... 219/216; 399/122, 399/322, 323, 400

(56) References Cited

U.S. PATENT DOCUMENTS

| | | | |
|---|---|---|---|
| 4,378,152 | A | 3/1983 | Edwards et al. |
| 4,876,576 | A | 10/1989 | Itaya et al. |
| 5,293,202 | A | 3/1994 | Adachi et al. |
| 6,029,038 | A | 2/2000 | Uehara et al. |
| 6,169,874 | B1 | 1/2001 | Quesnel et al. |

FOREIGN PATENT DOCUMENTS

| | | |
|---|---|---|
| JP | 55-111975 | 8/1980 |

*Primary Examiner*—Hoang Ngo
(74) *Attorney, Agent, or Firm*—Antonelli, Terry, Stout & Kraus, LLP

(57) ABSTRACT

An electrophotographic image forming system having a form cassette for storing forms, a transfer unit for forming an image, a feeder for feeding the forms to the transfer unit and a fusing device for fusing transferred image of the form. The electrophotographic image forming system provides in a path for feeding the form with unfused colored particles (toner) deposited thereon, a form guide so as to contact the non-printing area of the surface of the form with unfused colored particles (toner) deposited thereon.

5 Claims, 9 Drawing Sheets

ELECTROPHOTOGRAPHIC IMAGE FORMING SYSTEM

CROSS REFERENCE TO RELATED APPLICATION

This is a continuation of U.S. application Ser. No. 09/801,847, filed Mar. 9, 2001, the subject matter of which is incorporated by reference herein.

BACKGROUND OF THE INVENTION

The present invention relates to an electrophotographic image forming system.

Generally, upon receipt of a printed data, the electrophotographic image forming system converts it into an image data and applies such luminous flux as laser beam to a photoconductor to form an image by electric charge, which is a so-called latent image. Then colored particles (toner) are deposited thereon on an selective basis by a development device, and latent image is formed into an manifest image, on the one hand. On the other hand, a medium such as form is fed to the photoconductor by a feed means such as a roller, and the image formed on the photoconductor is transferred to the medium. Then the image is fused onto the form by a fusing device, thereby completing printing. In such an electrophotographic image forming system, a form to guarantee print quality is normally specified to ensure stable printing operation. Therefore, the user is required to get a form specified for each system. There is no problem if such a form can be easily obtained. If not, the user has to be prepared for poor print quality. In addition to poor print quality, jamming occurs where the form is wound on the drum, depending on the case. Therefore, when other than specified forms are used, printing operation is performed by supplying the form from the manual feed tray to ensure that the form feed path will be shaped in a straight line wherever possible. However, this method cannot solve the problem of the drum wound by paper as described above. Even if the specified form is used, the form does not always exhibit predictable behavior when changes in form storage conditions and surrounding environment are taken into account. The form fed at a high speed may give vibration to parts inside the form feed path or may contact them by instantaneous behavior, causing the unfused image to be disturbed. Furthermore, paper used for printing includes a great variety of forms such as plain paper which is also called a copy form, OHP form, label form, envelope and post card. They may be used on the electrophotographic image forming system. The media greatly differing in the thickness, rigidity and the degree of curling of the form may be used. Thus, the system is required to cope with a great variety of forms.

SUMMARY OF THE INVENTION

The object of the present invention is to provide an electrophotographic image forming system characterized by a mechanism of stabilizing the behavior of the tip of the form when the form with unfused colored particles (toner) deposited thereon is fed to the fusing device.

To achieve the above object, the present invention has a form posture correcting protrusion provided on the non-printing area of the surface of the form with unfused colored particles (toner) deposited thereon inside the feed path of the form with unfused colored particles (toner) deposited thereon, so that form behavior can be controlled when the form is fed to the fusing device.

DETAILED DESCRIPTION OF THE PREFERRED EMBODIMENT

Figure 1:
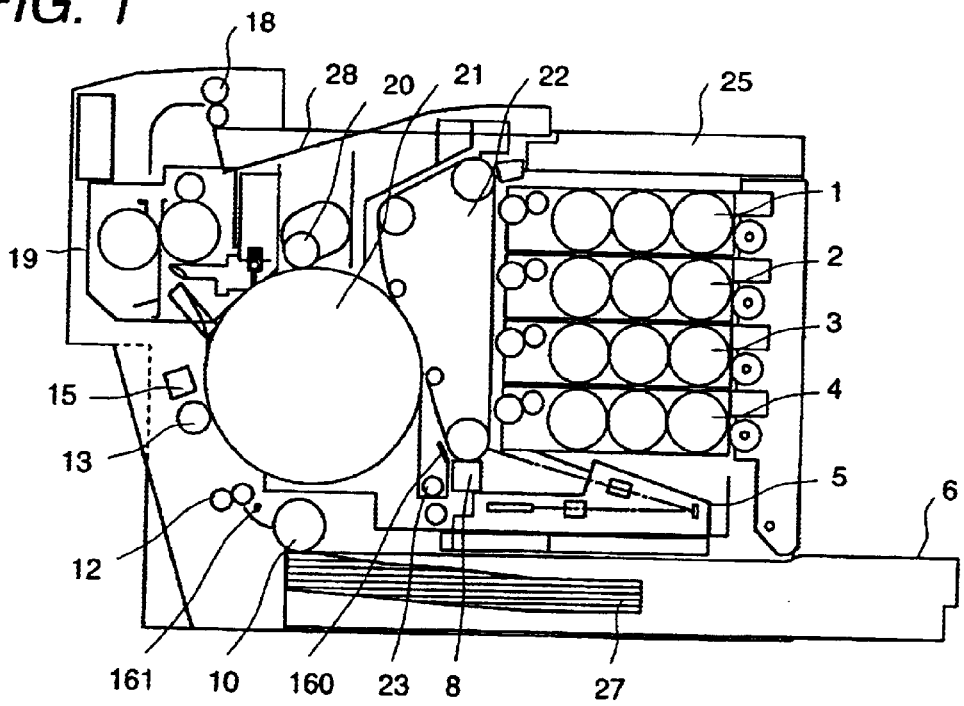
FIG. 1 is a cross sectional view of a printer with form guide representing one embodiment of the present invention.

The following describes one embodiment according to the present invention with reference to FIG. 1.

Figure 2:
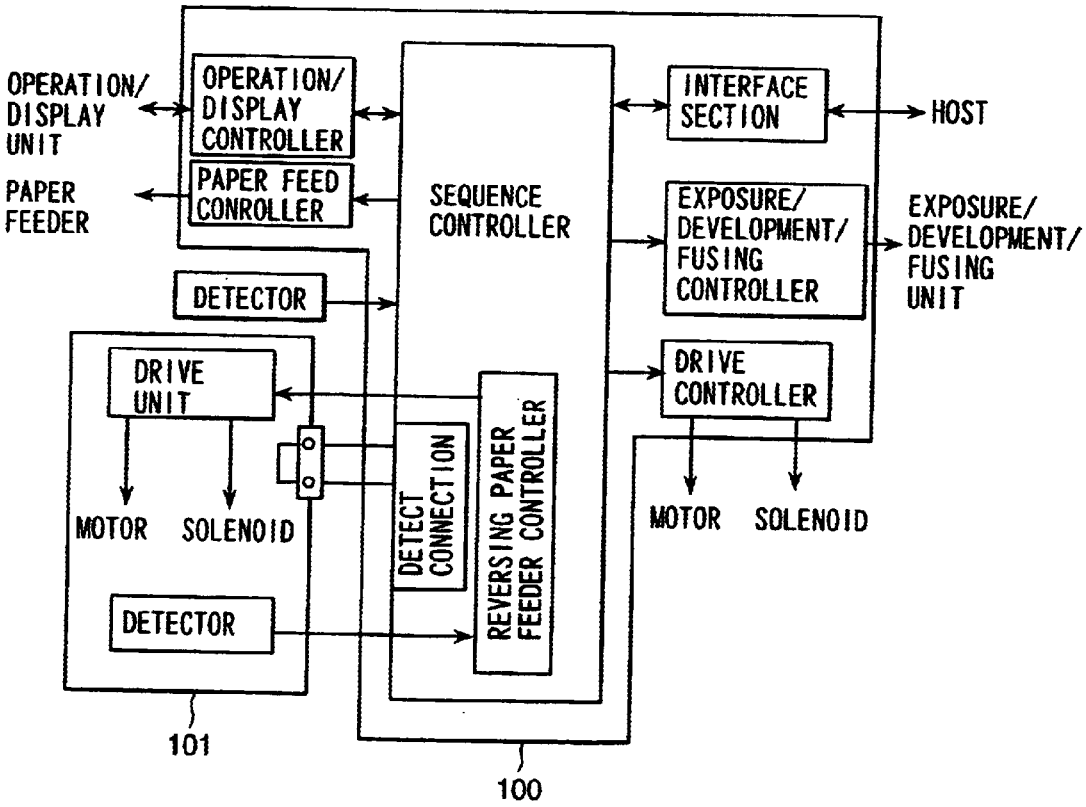
FIG. 2 is a control block diagram of the printer representing one embodiment of the present invention.

The printer 25 has major components comprising development devices 1 to 4, optical unit 5, a charging device 8, a photosensitive belt 22, a transfer drum 21, a paper feed roller 10, a resist roller 12, a transfer roller 13, an electric charge eliminator 15, a fusing device 19, a paper eject roller 18 and a paper feed cassette 6. FIG. 2 shows a control block. The control block can be broadly divided into two blocks; a printer controller 100 and a reversing paper feeder controller 101. The printer controller 100 comprises an interface section to exchange data with the host, an exposure unit, a development unit, a fusing unit, a motor as power source, a solenoid drive unit, an operation/display unit, a paper feed controller, a sequence controller for control of some detectors and a form reversing controller, and reversing paper feeder controller 101. The reversing paper feeder controller 101 comprises a motor as power source, solenoid, drive unit, some detectors, etc.

The following describes the operation of the printer 25.

Figure 3:
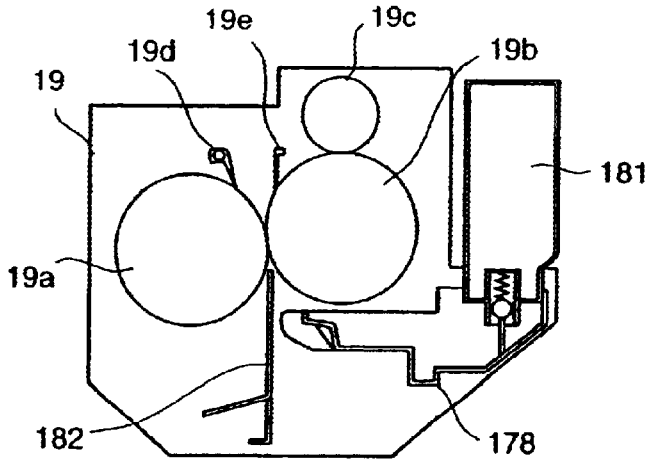
FIG. 3 is a cross sectional view of a fusing device representing one embodiment of the present invention.
Figure 4:
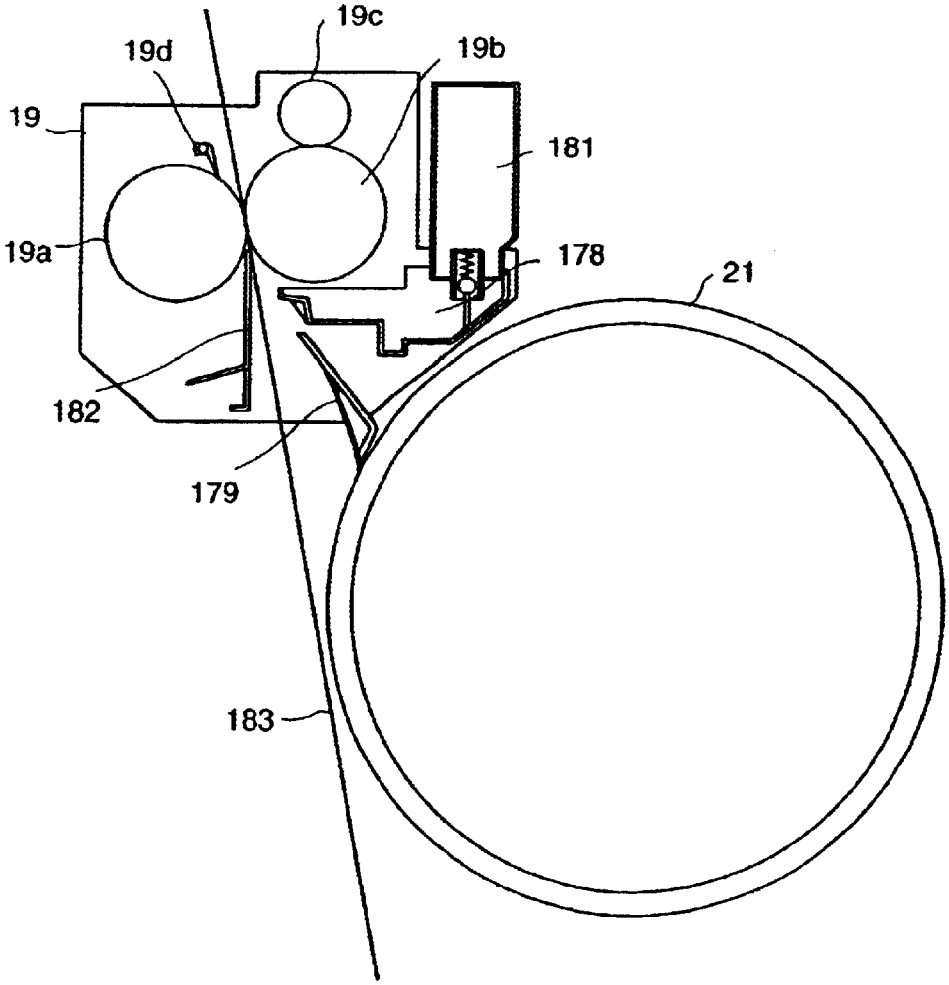
FIG. 4 (PRIOR ART)
FIG. 4 is a cross sectional view showing the layout of the transfer drum and fusing device in a conventional example.
Figure 5:
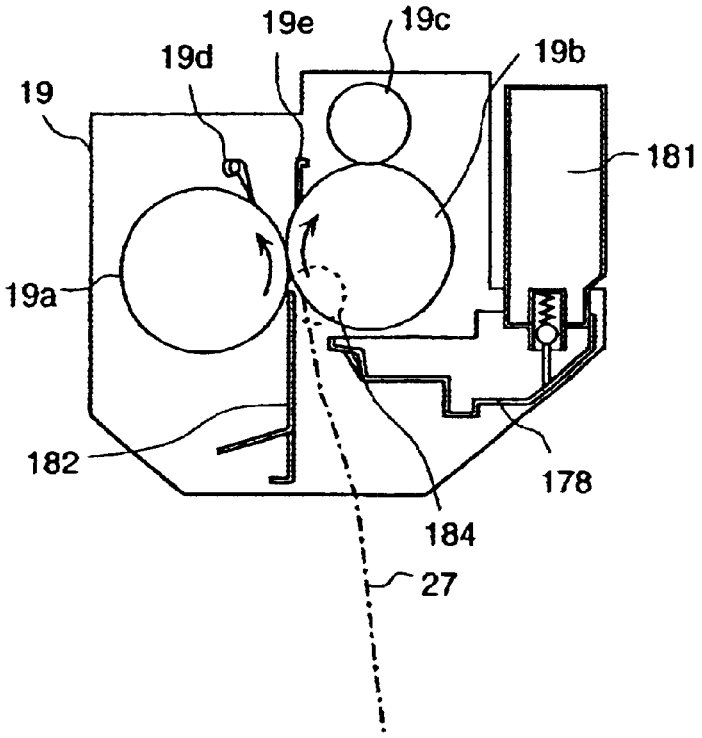
FIG. 5 (PRIOR ART)
FIG. 5 is a drawing representing contact of the form with the fusing roller in a conventional example.

The photosensitive belt 22 is electrostatically charged by a charging device 8 uniformly in response to the printing start signal from a host (not illustrated). A latent image is formed on the photosensitive belt 22 by the optical unit 5 according to the printed data sent from the host. The latent image is developed by any one of development devices 1 to 4, and colored particles (toner) in the development device are applied to the photosensitive belt 22. The photosensitive belt 22 is rotated by the drive source (not illustrated), and colored particles (toner) on the photosensitive belt 22 are transferred onto the transfer drum 21. Electric charge of the photosensitive belt 22 is eliminated by the erase lamp 160, and excess colored particles (toner) remaining on the photosensitive belt 22 are removed by belt cleaner 23. It is again electrostatically charged by the charging device 8. For color printing, this process is repeated by switching the development device. A visible image of single or multi-colored particles (toner) is formed on the transfer drum 21. Upon completion of the desired transfer operation or prior to completion, form 27 is pulled out of the form cassette 6 by the paper feed roller 10, and is made to wait at the resist roller 12. After the form is detected by the detector 161, the paper feed roller 10 stops after the lapse of a specified time. When the position of the visible image formed on the transfer drum 21 has agreed with the transfer position on the form, the feed of the form waiting at the resist roller 12 is again started, and the visible image is transferred to the form at the transfer roller 13. The form is separated from the transfer drum 21 by the electric charge eliminator 15, and colored particles (toner) are fused onto the form 27 by the fusing device 19. The form is then ejected to the paper eject tray 28. Excess colored particles (toner) remaining on the transfer drum 21 are removed by drum cleaner 20. FIG. 3 is a cross sectional view of the fusing device representing one embodiment of the present invention. The fusing device 19 has major components comprising a pressure roller 19*a*, fusing roller 19*b*, cleaning roller c, separator jaw 19*d*, form guide 19*e*, guide 182, oil bottle 181 and oil drip pan 178. The oil bottle 181 and oil drip pan 178 are getting less essential because oil-impregnated paper roll or oil-impregnated colored particles (toner) are coming to be used based on the recent technology, and the trend toward "oil-less" system is getting stronger. The form with unfused colored particles (toner) deposited thereon fed along the guide 182 is pressurized and heated by pressure roller 19*a* and fusing roller 19*b*. Colored particles (toner) are molten to stick onto the form. FIG. 4 is a cross sectional view representing the layout of transfer drum 21 and fusing device 19 in the conventional example. There will be no problem if the form 27 with colored particles (toner) transfer from the transfer drum 21 is fed along the ideal locus 183 of a straight line formed by connecting the contact parts of transfer drum 21, fusing roller 19*b* and pressure roller 19*a*. However, the form is actually fed away from the ideal locus 183, depending on the type of the form and the environment. FIG. 5 shows the contact of the form 27 to the fusing roller 19*b* in the conventional example. The form 27 having been fed along the guide 182 has the tip portion contacted by the pressure roller 19*a*, and is caught in by the contact part between fusing roller 19*b* and pressure roller 19*a* through the rotation of the pressure roller 19*a* in the arrow direction. As a result of collision angle between pressure roller 19*a* and the tip of the form 27, the tip of the form 27 instantaneously gives vibration and deformation to the fusing roller 19*b*. As a result, colored particles (toner) in an unfused state are deposited on the surface of fusing roller 19*b*. Then they are again transferred on the form 27 and fused there by re-contact between the form 27 and fusing roller 19*b*. This will disturb an image about 7 to 8 mm on the tip of the form.

Figure 6:
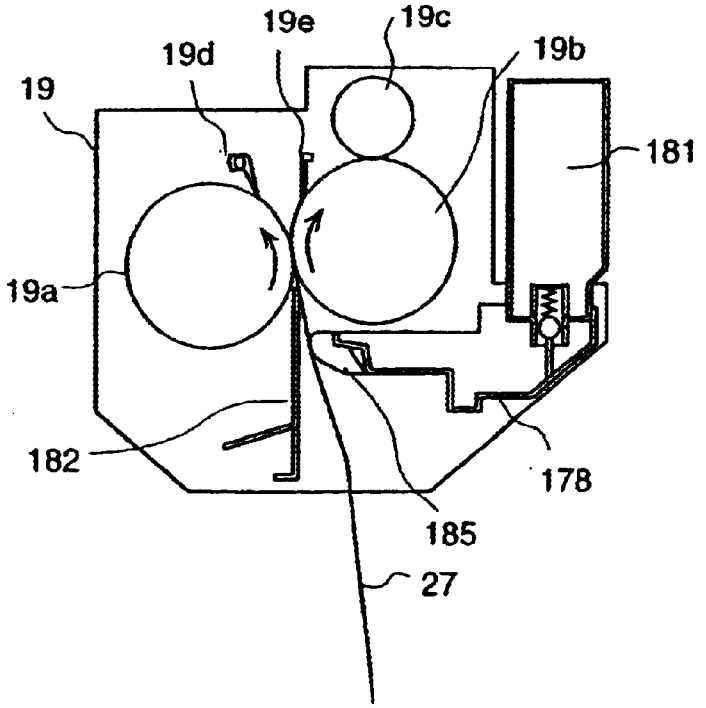
FIG. 6 is a drawing of correction of form posture representing one embodiment of the present invention.
Figure 7:
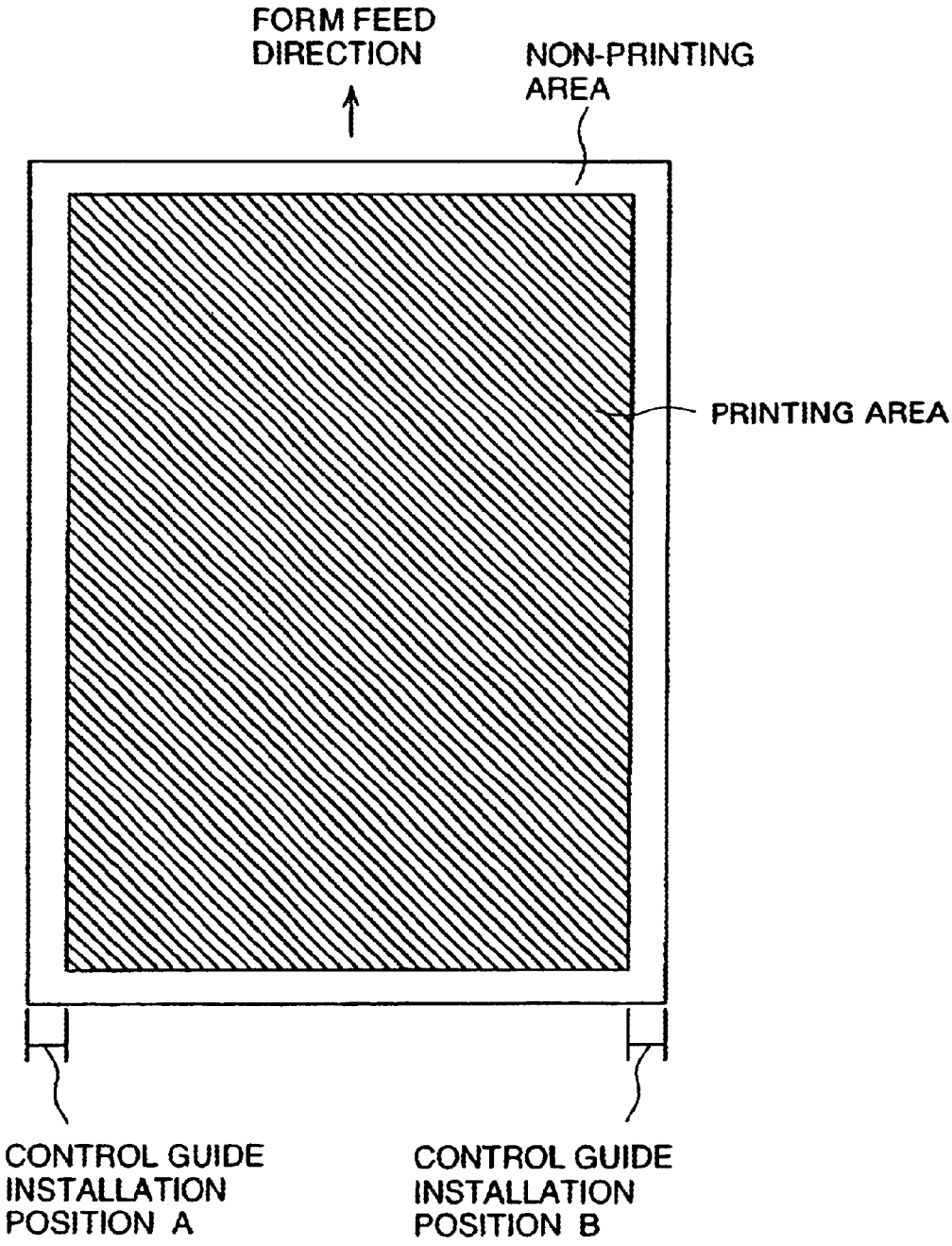
FIG. 7 is a drawing of the printing area representing one embodiment of the present invention.
Figure 8:
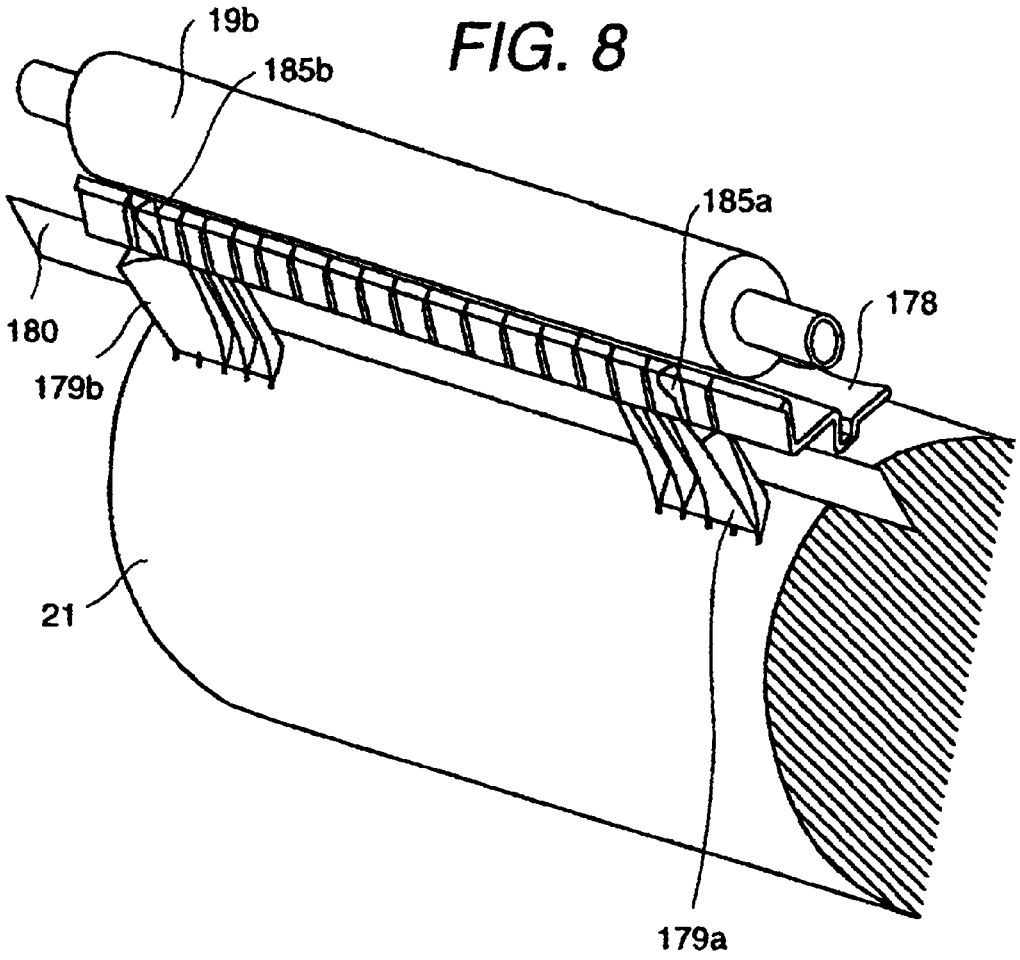
FIG. 8 is a perspective view of the form posture correcting protrusion representing one embodiment of the present invention.

FIG. 6 is a drawing representing correction of form posture representing one embodiment of the present invention. Regarding vibration and deformation given to fusing roller 19*b* by the form 27 when the form 27 with unfused colored particles (toner) deposited thereon contacts the pressure roller 19*a* described above, contact to the fusing roller 19*b* does not occur due to the effect of control guide 185 provided on the oil drip pan 178. The form posture correcting protrusion 185 is provided on the non-printing portion of the printing surface of the form shown in FIG. 7. It is located outside the printed area where image quality is guaranteed. FIG. 8 is a perspective view representing form posture correcting protrusion as one embodiment of the present invention. Form posture correcting protrusions 185*a* and 185*b* are provided on part of oil drip pan 178. These protrusions are located at the place corresponding to the non-printing portion on the printed surface of said form.

The present invention provides an electrophotographic image forming system having a form posture correcting protrusion for form deformation on the side of the form with unfused colored particles (toner) deposited thereon. This feature prevents vibration and deformation caused by the form being fed to the fusing device, independently of the type of the form, and ensures excellent print quality.

Figure 9:
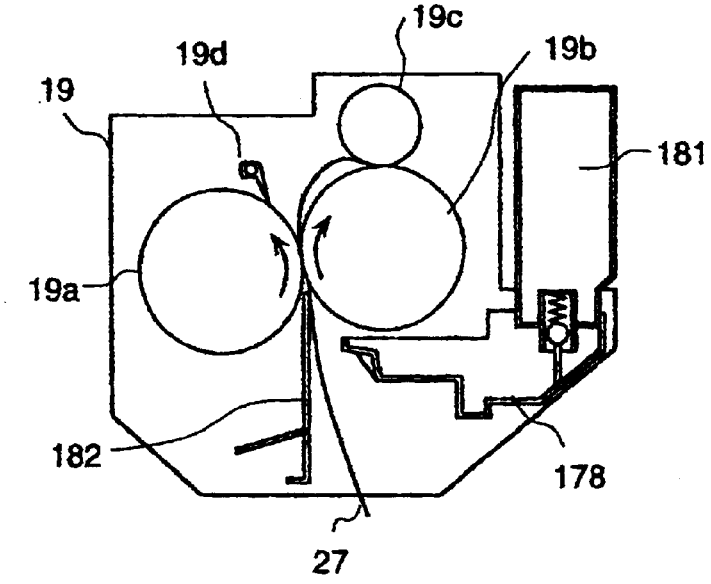
FIG. 9 is a cross sectional view representing the form wound on the fusing roller in a conventional example.
Figure 10:
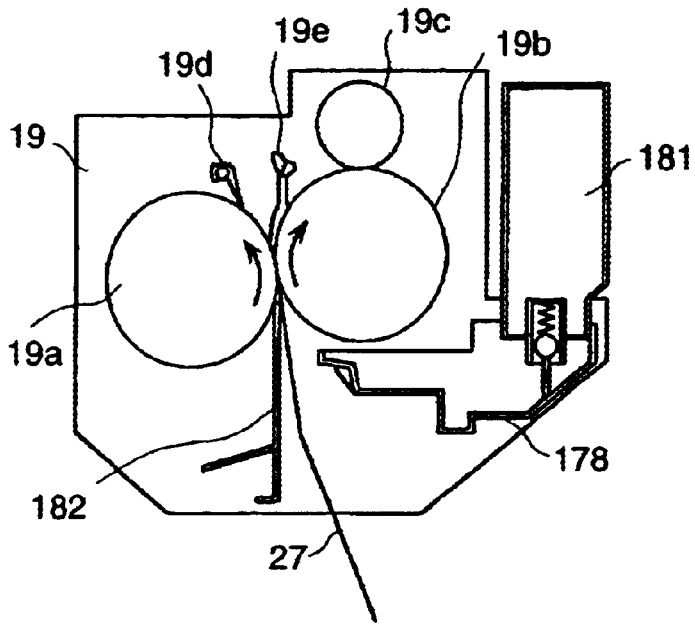
FIG. 10 is a cross sectional view representing the form separated by the form guide according to the present invention.
Figure 11:
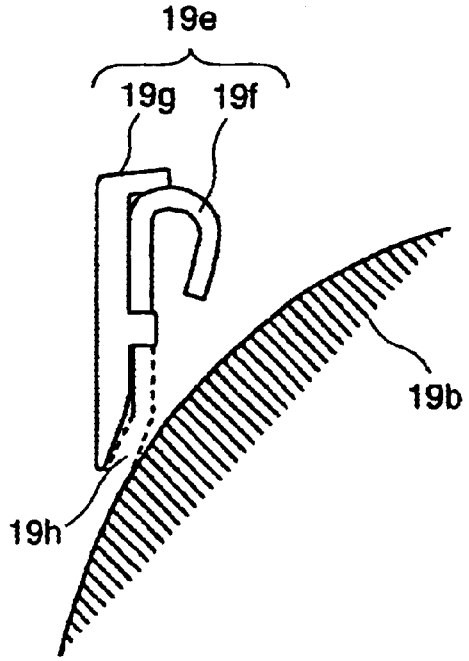
FIG. 11 is a cross sectional view of the form guide representing one embodiment of the present invention.
Figure 12:
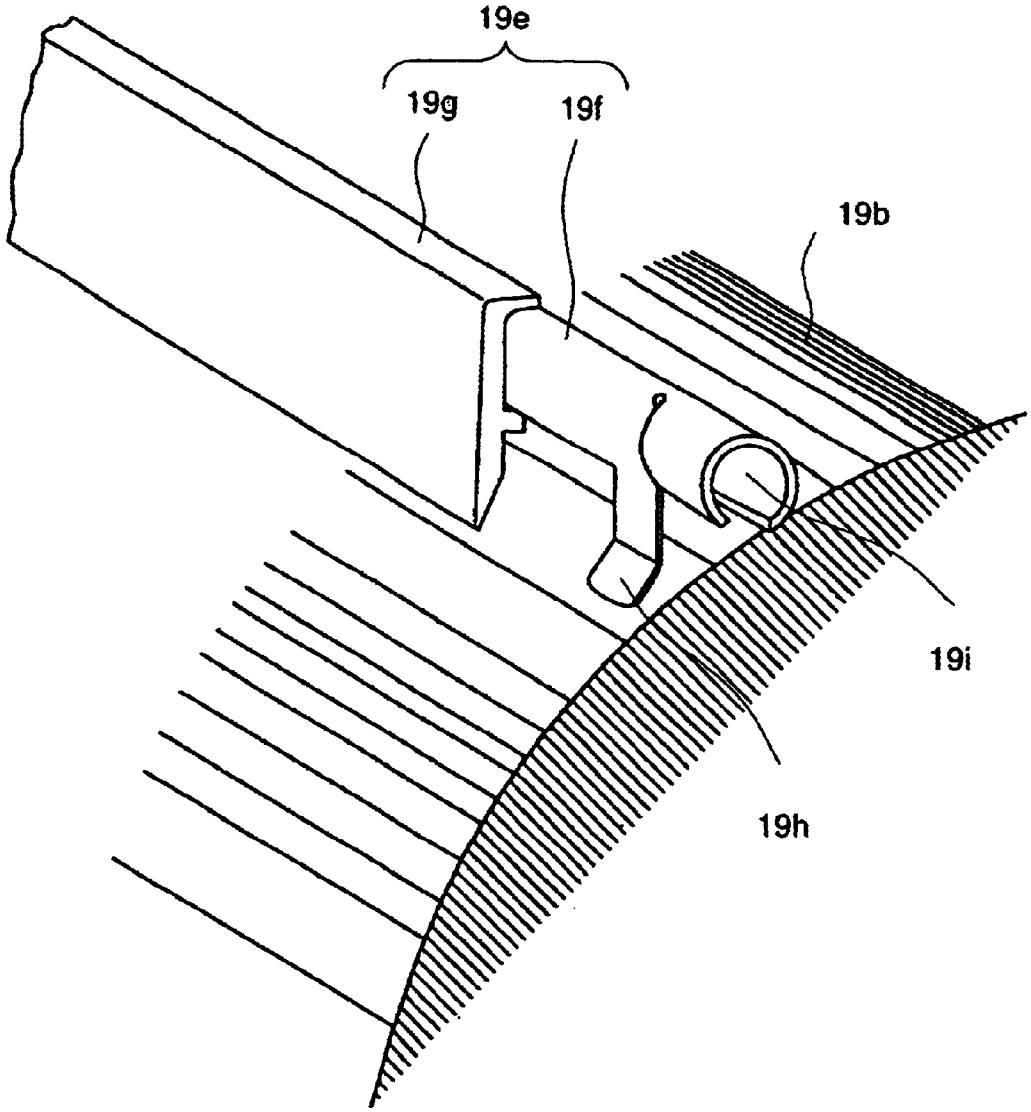
FIG. 12 is a perspective view of the form guide and fusing roller representing one embodiment of the present invention.
Figure 13:
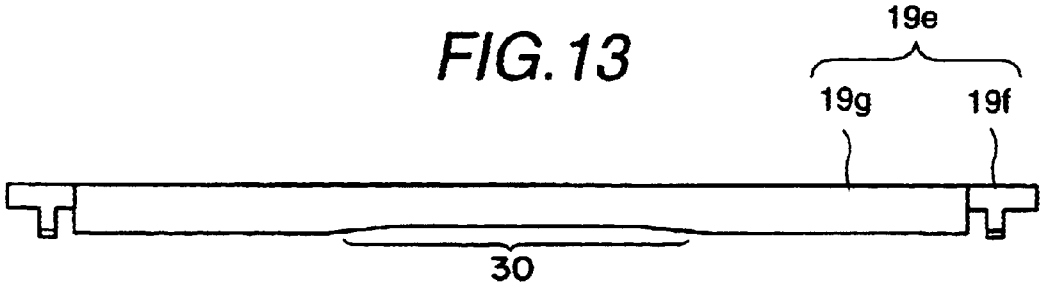
FIG. 13 shows an embodiment of a form guide representing one embodiment of the present invention.
Figure 14:
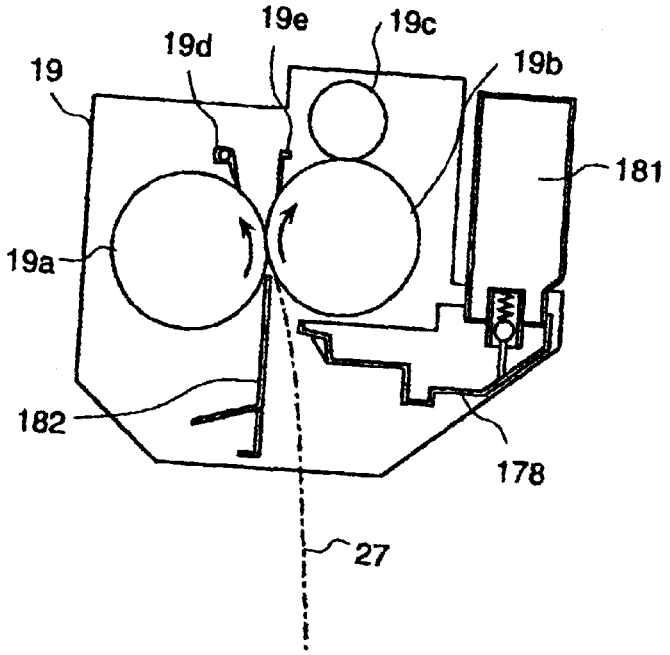
FIG. 14 is a drawing representing contact of the form with the fusing roller in a conventional example.
Figure 15:
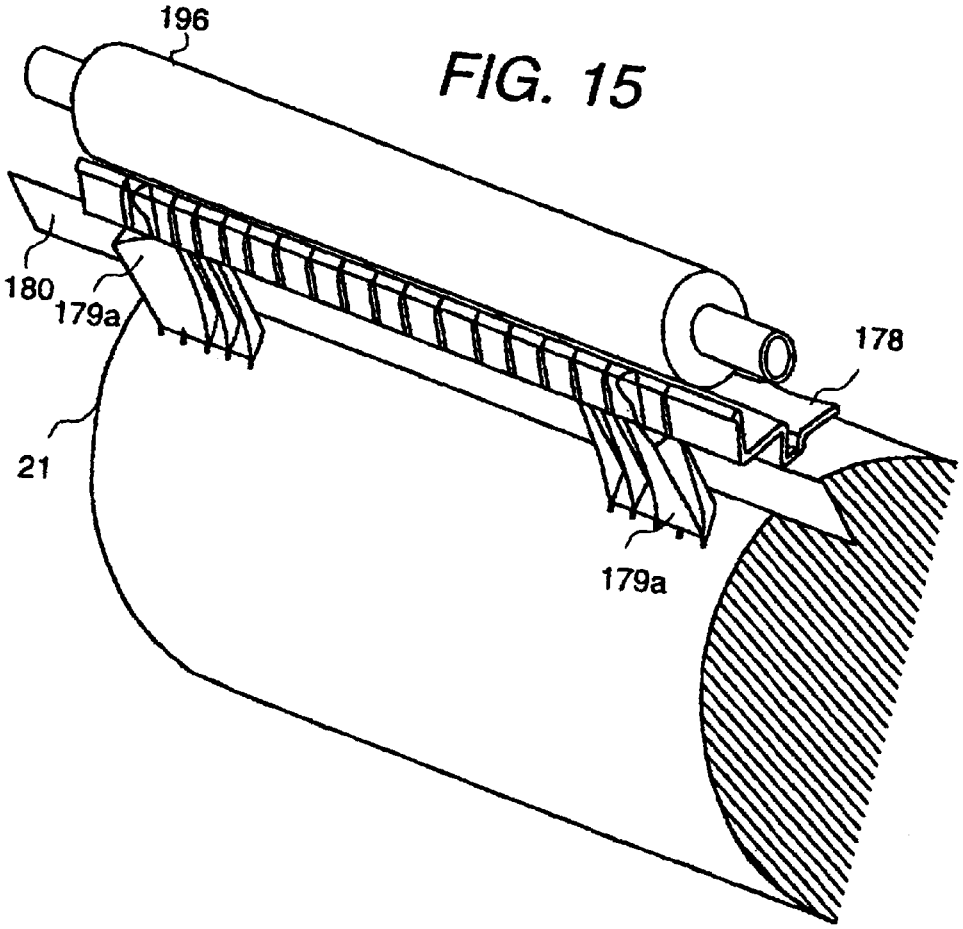
FIG. 15 is a perspective view of the form posture correcting protrusion representing one embodiment of the present invention.
Figure 16:
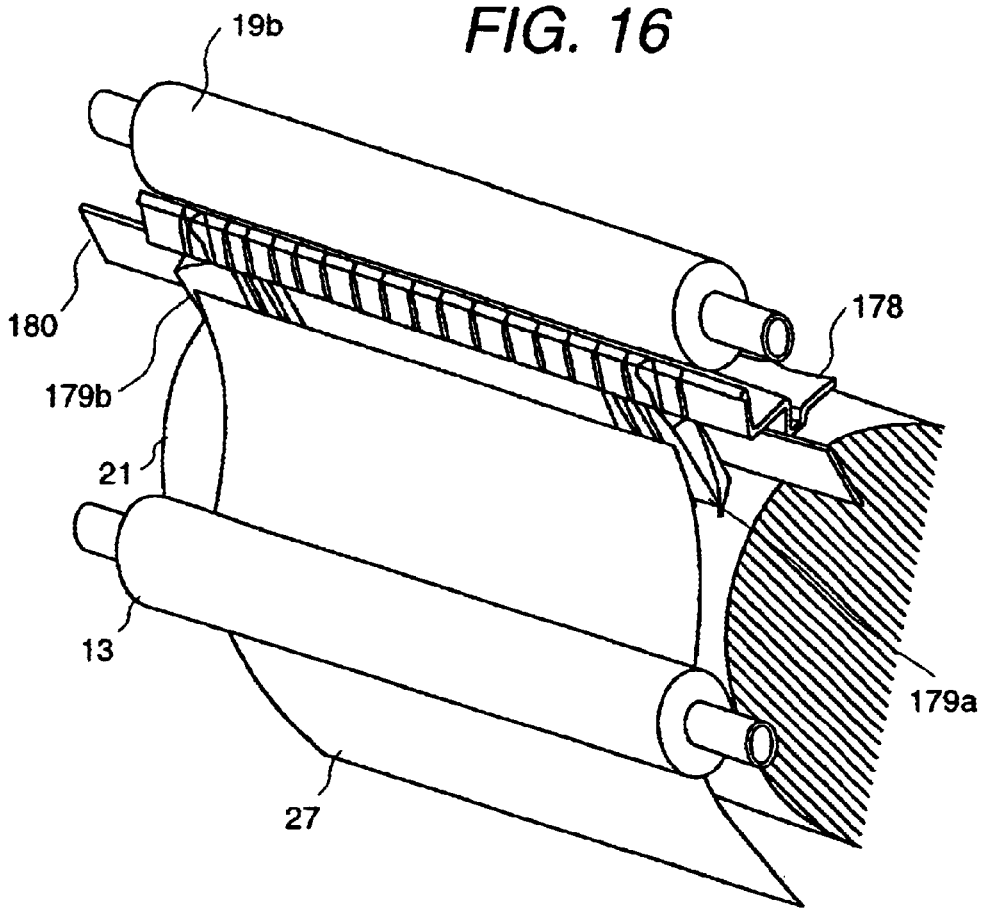
FIG. 16 is a perspective view of the relation between the form guide and form representing one embodiment of the present invention.
Figure 17:
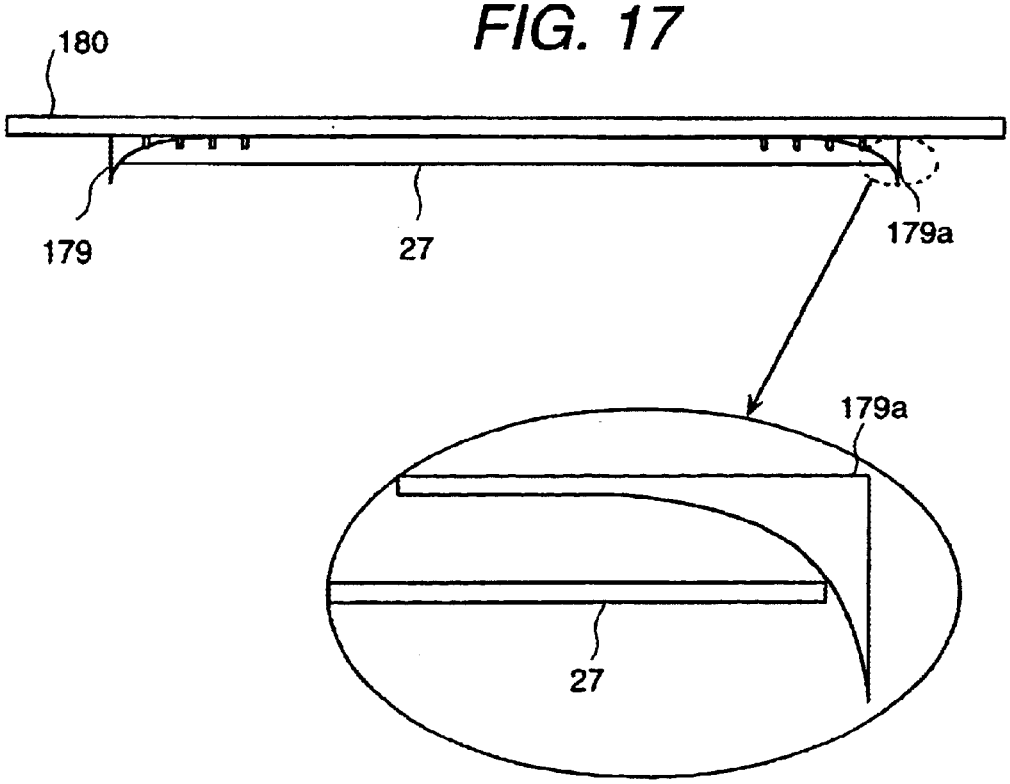
FIG. 17 is a cross sectional view of the relation between the form guide and form representing one embodiment of the present invention.

Furthermore, in a fusing device as shown in FIG. 9, the oil bottle 181 and oil drip pan 178 are getting less essential because oil-impregnated paper roll or oil-impregnated colored particles (toner) are coming to be used based on the recent technology, and the trend toward "oil-less" system is getting stronger. The form with unfused colored particles (toner) deposited thereon fed along the guide 182 is pressurized and heated by pressure roller 19*a* and fusing roller 19*b*. Colored particles (toner) are molten to stick onto the form. The form passing between fusing roller 19*b* and pressure roller 19*a* is made to curl toward the fusing roller 19*b* by molten colored particles (toner), as shown in FIG. 9. Depending on the degree of rigidity of form 27, the paper is deformed to the extent of winding around the fusing roller 19*b*, as shown in FIG. 9. In FIG. 10, the deformed form after fusing is prevented by the form guide 19*e* from being wound in toward the fusing roll 19*b* and cleaning roller 19*c*. Therefore, form 27 after fusing is fed out of the fusing device 19 along the form guide 19*e*. FIG. 11 is a cross sectional view representing the form guide 19*e*. The form guide 19*e* is composed of a dual structure consisting of a metallic member 19*f* such as stainless steel and aluminum and heat resistant resin 19*g* such as plastics. It is installed close to the fusing roller 19*b*. The heat resistant resin 19*g* is installed with a clearance of about 0.5 m without contacting the fusing roller 19*b*. FIG. 12 is a perspective view representing the form guide 19*e* and fusing roller 19*b*. The protrusion 19*h* provided on the metallic member 19*f* contacts the surface of the fusing roller 19*b* to maintain clearance between the resin 19*g* of the form guide and fusing roller 19*b*. Each end of the metallic member 19*f* is provided with a support joint which is held by the casing of the fusing device 19. The heat resistant resin 19*g* has a concave 30 provided at the center as shown in FIG. 13, thereby avoiding possible contact between fusing device 19 and heat resistant resin 19*g* by thermal deformation.

The present invention provides an electrophotographic image forming system having a form guide on the form ejection side of the fusing device. This feature prevents the form from being wound on the fusing roller of a fusing device, and ensures correct form feed.

Furthermore, FIG. 5 shows the contact of the form 27 to the fusing roller 19*b* in the conventional example. The form 27 having been fed along the guide 182 has the tip portion contacted by the pressure roller 19*a*, and is caught in by the contact part between fusing roller 19*b* and pressure roller 19*a* through the rotation of the pressure roller 19*a* in the arrow direction. As a result of collision angle between pressure roller 19*a* and the tip of the form 27, the tip of the form 27 instantaneously gives vibration and deformation to the fusing roller 19*b*. As a result, colored particles (toner) in an unfused state are deposited on the surface of fusing roller 19*b*. Then they are again transferred on the form 27 and fused there by re-contact between the form 27 and fusing roller 19*b*. This will disturb an image about 7 to 8 mm on the tip of the form. FIGS. 6 and 7 are perspective views representing the relationship between the form guides 179*a* and 179*b* and form 27. As described above, deformation of the form caused by the form 27 contacting the pressure roller 19*a* results in not only the contact with the fusing roller 19*b* but also contact with the transfer drum 21, depending on the type of the form fed. As for the state of printing in this case, colored particles (toner) once transferred onto the form 27 returns to the transfer drum 21 again, and the image of the portion in contract is removed after fusing. This results in serious deterioration of image quality. Form guide 179*a* and 179*b* are laid out so that they contact the end of the form 27 alone, in order to ensure that they do not contact the surface with colored particles (toner) deposited thereon, and do not re-contact transfer drum 21. As a result, deposited colored particles (toner) are not affected. When the deformation of the form 27 is not very serious, these form guides 179 and 179*b* and the form 27 do not contact. FIG. 8 shows the relation between the form 27 and form guides 179*a* and 179*b*. When form deformation has increased, the end of the form 27 contacts the sloping portion of form guides 179*a* and 179*b*. Thus, further deformation of the form 27 is controlled at the time of contact. This makes it possible to avoid re-contact of transfer drum 21 with the surface having colored particles (toner) deposited thereon. The sloping portion of the form guides 179*a* and 179*b* can be either straight or curved. The shape is determined along the feed locus of the form 27. Although not described herein, it can easily assumed that the distance between form guide A179*a* and form guide B179*b* can be changed automatically in conformity to the size of form 27.

The present invention provides an electrophotographic image forming system having a form deformation control guide on the surface of the form with unfused colored particles (toner) deposited thereon. This feature allows deformation to be controlled, independently of the type of the form, and ensures excellent print quality.

What is claimed:

1. An electrophotographic image forming system comprising a form cassette for storing forms;

a transfer unit for forming an image;

a feed means for feeding said form to said transfer unit;

a fusing device for fusing transferred image of said form; and a form guide provided close to a fusing roller of said fusing device;

said electrophotographic image forming system characterized in that a central portion of said form guide has a concave portion.

2. An electrophotographic image forming system according to claim 1 characterized in that said form guide consists of a combination of metal and resin.

3. An electrophotographic image forming system according to claim 1 characterized in that said form guide is provided with a protrusion which contacts part of the roller of said fusing device.

4. An electrophotographic image forming system according to claim 2 characterized in that a central portion of said resin of said form guide has the concave portion of said form guide therein.

5. An electrophotographic image forming system according to claim 1 characterized in that said form guide is an elongated member having an elongated central portion of resin and at least end portions of metal, the central portion of said resin having the concave portion of said form guide at a middle part thereof.

* * * * *